US007254918B2

(12) United States Patent
Fronz et al.

(10) Patent No.: US 7,254,918 B2
(45) Date of Patent: Aug. 14, 2007

(54) EMERGENCY UNLOCKING DEVICE FOR LOCKING AND UNLOCKING SYSTEMS FOR SWINGING SLIDING DOORS, IN PARTICULAR OF RAIL VEHICLES

(75) Inventors: Reinhard Fronz, Dessau (DE); Wolfgang Steiniger, Geesthacht (DE)

(73) Assignee: Fahrzeugtechnik Dessau AG, Dessau (DE)

( * ) Notice: Subject to any disclaimer, the term of this patent is extended or adjusted under 35 U.S.C. 154(b) by 247 days.

(21) Appl. No.: 10/987,689

(22) Filed: Nov. 12, 2004

(65) Prior Publication Data

US 2006/0101718 A1 May 18, 2006

(51) Int. Cl.
*E05F 15/00* (2006.01)
*E05F 17/00* (2006.01)
*E05B 65/10* (2006.01)

(52) U.S. Cl. ..... 49/122; 49/118; 49/141; 49/280

(58) Field of Classification Search ..... 49/141, 49/122, 280, 279, 116, 118
See application file for complete search history.

(56) References Cited

U.S. PATENT DOCUMENTS 1,335,750 A * 4/1920 Pearson ..... 49/107
2,589,480 A * 3/1952 Curtis ..... 160/188
4,235,169 A * 11/1980 Peterson ..... 105/251
2006/0174540 A1* 8/2006 Oberleitner ..... 49/118

FOREIGN PATENT DOCUMENTS

| | | | |
|---|---|---|---|
| DE | 38 08 390 | A1 | 10/1988 |
| DE | 197 45 753 | C2 | 4/1999 |
| DE | 101 16 580 | A1 | 10/2002 |
| DE | 101 16 583 | A1 | 10/2002 |
| EP | 0 197 025 | A1 | 10/1986 |
| EP | 0 335 860 | A1 | 10/1989 |
| GB | 2 202 897 | A | 10/1988 |

* cited by examiner

*Primary Examiner*—Jerry Redman
*Assistant Examiner*—Andrea L. Coulter
(74) *Attorney, Agent, or Firm*—Laurence A. Greenberg; Werner H. Stemer; Ralph E. Locher

(57) ABSTRACT

An emergency unlocking device for locking and unlocking systems for swinging sliding doors, in particular of rail vehicles. The emergency unlocking device has a traction device that engages on a first spring-loaded pivoted lever that is connected via a second lever to a third lever. The third lever is attached to the axial shaft of a spring-loaded rotary magnet and has elongate holes in which a bolt is displaceably mounted. When the traction device is subjected to tensile stress, the bolt engages with a fourth lever that is pivotably mounted on a shaft, and moves the fourth lever. The fourth lever is operatively connected via a coupling rod and deflection unit to a locking rod that moves the vertical direction. A rod, via which a force component that brings about the locking and unlocking of the door leaves can be applied, engages on the fourth lever.

16 Claims, 6 Drawing Sheets

EMERGENCY UNLOCKING DEVICE FOR LOCKING AND UNLOCKING SYSTEMS FOR SWINGING SLIDING DOORS, IN PARTICULAR OF RAIL VEHICLES

BACKGROUND OF THE INVENTION

Field of the Invention

The invention relates to an emergency unlocking device for locking and unlocking systems for swinging sliding doors, in particular of rail vehicles.

Locking and unlocking systems for swinging sliding doors of rail vehicles in which a plurality of identical functional elements for locking and unlocking, which are connected to one another in an articulated fashion by connecting rods, are disposed on at least one vertical closing edge, are known. By moving the connecting rod, the functional elements are moved into the locking and unlocking position (see Published, Non-Prosecuted German Patent Applications DE 38 08 390 A1 and DE 101 16 583 A1).

Emergency unlocking devices or emergency activators for swinging sliding doors are known in a variety of embodiments. Published, European Patent Application EP 0 335 860 A1 discloses an emergency unlocking device in which a slide which engages on the door drive and which is held by a securing device in a position which corresponds to the final closed position of the door, the holding device being capable of being manually activated, is disposed in the region of the final closed position.

Published, European Patent Application EP 0 197 025 A1 describes an emergency unlocking device in which a latch on the door leaf interacts with a bolt which is fixed to the door frame and to which an unlocking lever which is acted on by a force source is assigned. The emergency unlocking is triggered by a Bowden cable using a lever system which is embodied as a toggle joint lever, is coupled fixedly to the door frame and engages on the unlocking lever.

An emergency unlocking process by decoupling the drive connection between the electric motor and the rotary column by a specific unlocking mechanism is known from Published, European Patent Application EP 1 072 749 A2.

An emergency unlocking device (see German Patent DE 197 45 753 C2) with a second drive as a pneumatic actuator element in which the emergency activation element is moved out of the locked position into a position lying before the emergency dead center position, out of which position the manual activation of the door leaf takes place, is also known.

The known emergency unlocking systems are generally only suitable for a specific locking and unlocking process. However, in practice swinging sliding doors with different locking and unlocking processes as well as associated emergency unlocking processes are offered by one manufacture. This results in increased expenditure and additional costs.

SUMMARY OF THE INVENTION

It is accordingly an object of the invention to provide an emergency unlocking device for locking and unlocking systems for swinging sliding doors, in particular of rail vehicles which overcomes the above-mentioned disadvantages of the prior art devices of this general type, which is simple and cost-effective and is distinguished by a high level of reliability.

The emergency unlocking device is composed of a lever system, having a first spring-loaded pivoted lever on which the traction device, preferably a Bowden cable, engages. The lever is connected via a second lever to a third lever, the third lever being attached to the axial shaft of a spring-loaded rotary magnet and has elongate holes. A bolt is displacably mounted in the elongate holes and, when the traction device is subjected to tensile stress, the bolt engages with a fourth lever which is pivotably mounted on a shaft and moves the lever. The fourth lever is operatively connected via at least one horizontally disposed coupling rod and deflection unit to a locking rod that can be moved in the vertical direction. A rod, via which the force component which brings about the locking and unlocking of the door leaves can be temporarily applied, also engages on the fourth lever. The proposed lever system for emergency unlocking can be used as a compact and separate assembly for different locking and unlocking devices. A further advantage is that it takes up only a relatively small installation space. The emergency unlocking device can be activated manually by a Bowden cable which is attached to the first pivoted lever. The complete lever system can be mounted on a mounting plate or a carrier element. The fourth lever can additionally also be used as a functional element for the locking and unlocking device.

In a fourth variant, the second lever is embodied as a bent clip that is secured in the first pivoted lever in the manner of a rotary joint so as to be offset with respect to its axis of rotation. The bolt, which is operatively connected to the third lever that has a recess which serves as a horizontal guide and congruent elongate holes as a vertical guide, is disposed at the protruding end of the clip in the vertical direction. The fourth lever has, at its end pointing to the third pivoted lever, a semicircular or claw-shaped recess which temporarily engages with the bolt which is guided in the second lever.

The first lever, the third lever and the fourth lever are embodied as pivoted levers that are mounted on a horizontally disposed plate or a carrier element.

The traction rod engages on the fourth pivoted lever, opposite the recess, in order to transmit a movement force. The fourth pivoted lever is rigidly connected, for example, to a vertical shaft that lies on its axis of rotation. At the lower end of the shaft it is possible to attach a lever to which at least one coupling rod for transmitting a movement force for the locking and unlocking processes is attached.

In order to decouple the emergency unlocking device according to the first variant, the axis of rotation of the spring-loaded rotary magnet is disposed in the vertical direction, the third lever which is attached to the shaft being capable of being moved in the counterclockwise direction in the state in which voltage is applied to the rotary magnet, and as a result the bolt disengages from the claw-shaped recess of the pivoted lever. According to a further refinement variant of the emergency unlocking device, a mount which has a guide in which the traction device, the Bowden cable, is held under tension by a spring is disposed in the upper region of the door frame, the first pivoted lever being embodied as a clip-like lever at a distance from the guide. The lever is pivotably mounted on the mount and the two arms are connected at the upper end by a bolt on which the traction device and the second lever engage. The second lever is composed of a bent component piece and a straight component piece, the upper end of the bent component piece being connected to the bolt, and the end of the straight component piece being mounted centrally on the bolt of the third lever. The third lever is embodied as a U-shaped lever in whose side walls the elongate holes are located. The rear side wall has a lengthened section which is connected to the axial shaft of the rotary magnet, which shaft is disposed horizontally. The fourth lever is embodied as a hinged plate which is mounted on a mounting plate arranged in the upper region of the door frame, on a horizontally arranged shaft, the hinged plate having at the end in the lower region an arcuate recess and at the lower end a slot-shaped cutout which extends in the longitudinal direction and engages in the straight component piece of the second lever. On the bolt of the third lever, in each case a disk is disposed adjacent to the straight component piece of the second lever, which disk engages, when the Bowden cable is activated, with the section of the fourth lever which bounds the arcuate recess, and moves the lever in the clockwise direction about its axis of rotation. A coupling rod engages in the upper region and in the lower region, in each case so as to be offset with respect to one another, on the hinged plate, the fourth lever, the coupling rods extending horizontally in opposite directions and being operatively connected to the vertically movable locking rods by deflection units in the region of the vertical closing edges. A further rod engages on the hinged plate directly opposite the articulation point of the upper coupling rod, the further rod engaging with its opposite end on one of the end sides of a plate which is mounted so as to be eccentrically rotatable on a vertical shaft. A tappet, which is connected to the rotatable casing of the motor, engages on another end side of this plate, preferably approximately diagonally opposite.

In order to decouple the emergency unlocking variant, an electrical voltage is applied to the spring-loaded rotary magnet, as a result of which the U-shaped lever, which is connected to the axial shaft of the rotary magnet, is pivoted in the clockwise direction and the bolt with the disks is disengaged from the arcuate recess of the hinged plate.

This embodiment variant for emergency unlocking with decoupling permits simple mounting and has a high level of functional reliability.

Other features which are considered as characteristic for the invention are set forth in the appended claims.

Although the invention is illustrated and described herein as embodied in an emergency unlocking device for locking and unlocking systems for swinging sliding doors, in particular of rail vehicles, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
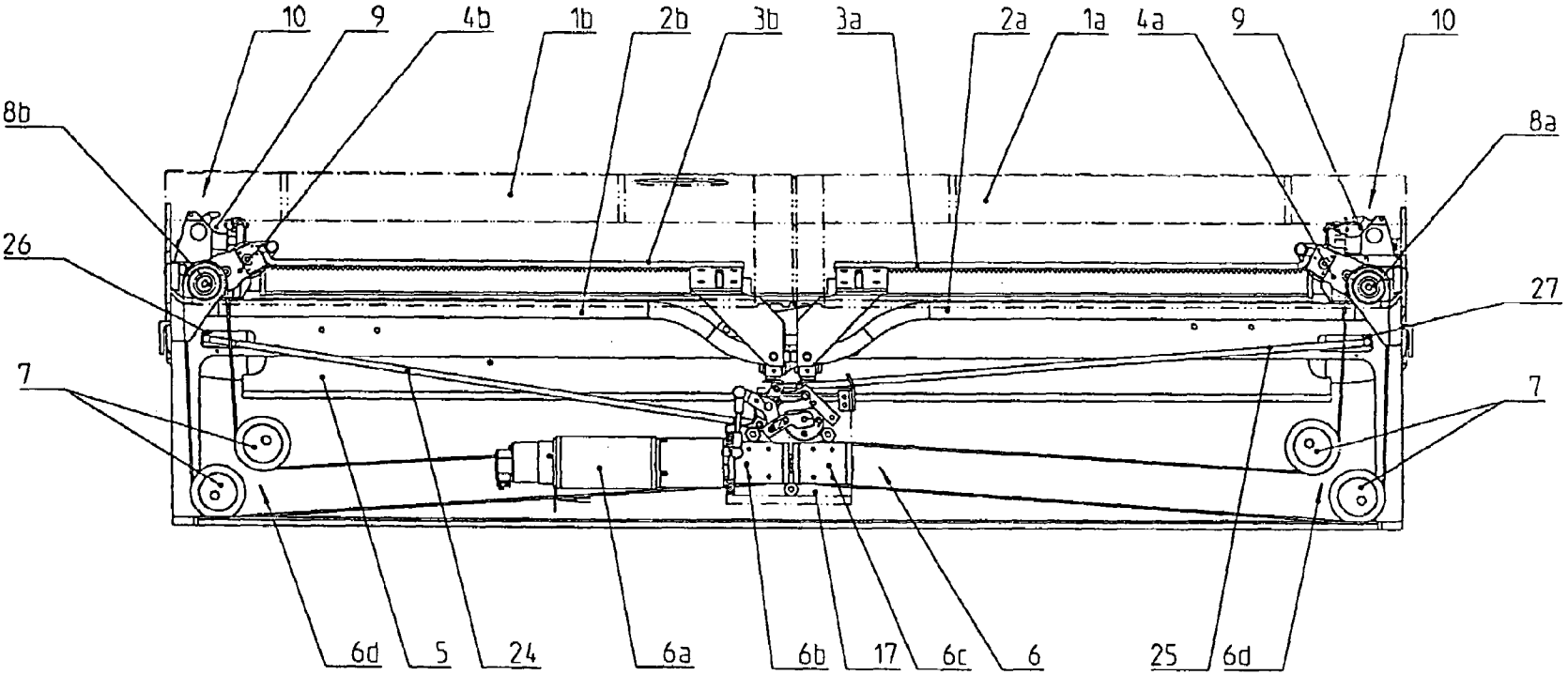
FIG. 1 is a diagrammatic, plan view of a two-wing swinging sliding door in an installed and closed state, according to the invention.
Figure 2:
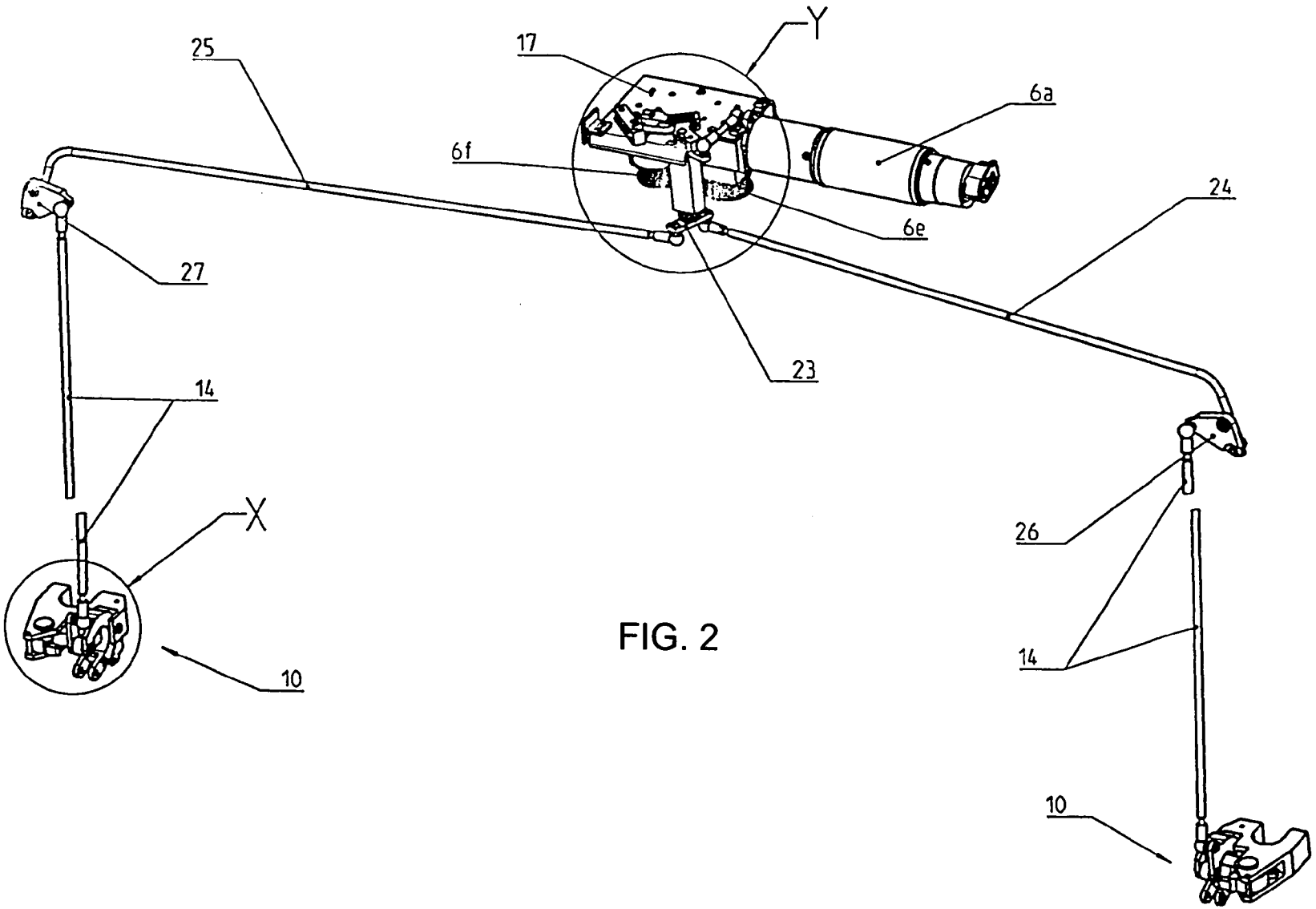
FIG. 2 is a frontal perspective view of a locking and unlocking mechanism which is disposed on a door frame and has an associated drive for the swinging sliding door according to FIG. 1.

Referring now to the figures of the drawing in detail and first, particularly, to FIG. 1 thereof, there is shown a two-wing swinging sliding door which closes a door opening and is composed of two door leaves 1*a* and 1*b*. The outsides of which form, in a closed state, a plane with the outer wall of the vehicle. The door leaves 1*a*, 1*b* are attached in the upper region to roller carriages which are guided in one curved roller guide 2*a* and 2*b* each. In order to displace the door leaves 1*a*, 1*b* in the transverse and longitudinal directions, toothed racks 3*a* and 3*b* are attached to them in the upper and lower regions and are formed with curved initial sections and engage with slewing gears 4*a* and 4*b*. Furthermore, in the upper region of the wagon body there is a drive unit 6 which mounted on a base plate 5 and is composed of a horizontally disposed d.c. motor 6*a* which uses two conical gear mechanisms 6*b*, 6*c* and a toothed belt gear mechanism 6*d* to bring about an opposed movement at connecting shafts to crown gears 6*e*, 6*f* (FIG. 2). The drive torque is transmitted from the crown gears 6*e*, 6*f* of the conical gear mechanism 6*b*, 6*c* to the synchronizing disks of the upper slewing gear mechanisms 4*a*, 4*b* by the toothed belt gear mechanism 6*d* via tensioning pulleys 7 in each case. The tensioning pulleys 7 are located on a tensioning device that is attached to the base plate 5. The two conical gear mechanisms 6*b*, 6*c* are connected to one another via a clutch. The torque is transmitted from the d.c. motor 6*a* to the transmission shaft by a passive spring connection. The motor housing can thus be rotated about its axis. The synchronously operating slewing gears that are movably mounted on respective vertical connecting shafts 8*a*, 8*b* are each disposed in a housing. The connecting shafts 8*a*, 8*b* are if necessary adapted by articulated connections of the contour of the outer wall of the vehicle. In the closed state of the door leaves 1*a*, 1*b*, the slewing gears 4*a*, 4*b* are in a home position in which they extend approximately parallel to the longitudinal center axis of the vehicle. In the home position, the supporting roller of the slewing gear 4*a*, 4*b* lies in the radius of the curved initial section of the toothed rack 3*a*, 3*b*. By rotation of the drive pinion of the slewing gear 4*a*, 4*b* which engages with the toothed rack 3*a*, 3*b*, the drive pinion moves along the curved initial section and in doing so presses the respective door leaf 1*a*, 1*b* transversely out of the plane of the side wall-about the axis of the supporting roller located opposite-and into the displacement position for the subsequent longitudinal displacement of the door leaf. In the process, one of the slewing gears 4*a* is swung about the vertical axis in the clockwise direction through an angle of approximately 90° as far as a stop, and the other slewing gear 4*b* is swung in the opposite direction. The rotational movement of the drive pinion is thus converted into a translatory movement transversely and longitudinally with respect to the longitudinal center axis of the vehicle, and as a result the respective door leaf 1*a*, 1*b* is moved out of the plane of the side wall and at the same time slightly in the longitudinal direction. The longitudinal displacement of the door leaves 1*a*, 1*b* parallel to the outer wall of the vehicle, until the door opening is completely cleared, is brought about by the further rotational movement of the pinion of the slewing gears 4*a*, 4*b* which engages with the straight section of the toothed rack 3*a*, 3*b*. In a manner known per se, the door leaves 1*a*, 1*b* are attached to roller carriages which are guided in the curved roller guides 2*a*, 2*b* which are attached to the wagon body in a stationary fashion. The method of transverse and longitudinal displacement of the door leaves explained above is known from Published, Non-Prosecuted German Patent Application DE 101 16 580 A1.

Figure 3:
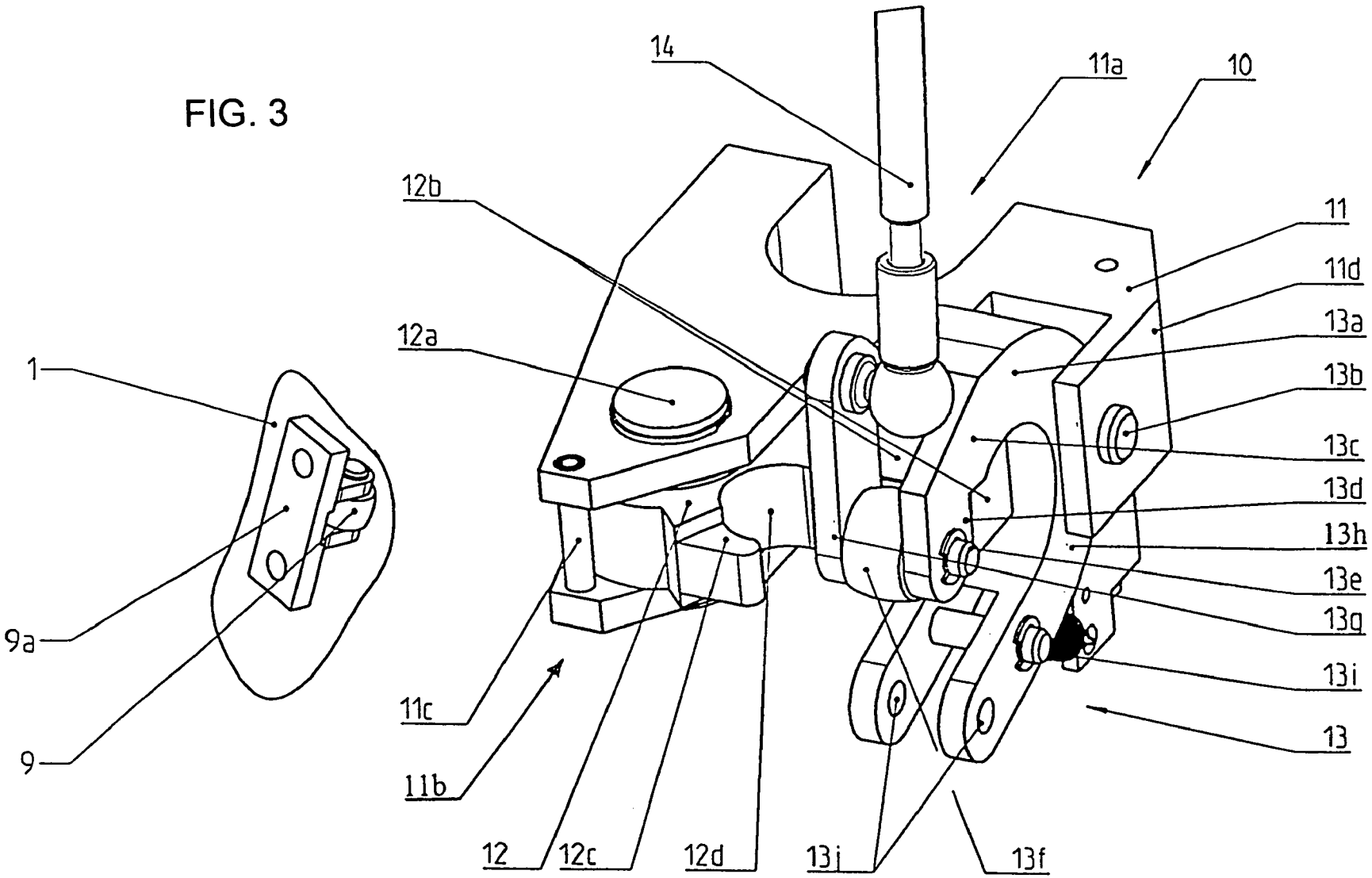
FIG. 3 is an enlarged, perspective view of detail "X" shown in FIG. 2.

In order to lock and unlock the door leaves 1*a*, 1*b*, necessary locking elements 10 are located on the external vertical longitudinal sides of the respective closing edges, as can be seen in FIG. 2. The complete structure of the locking device which is disposed on the inside of the door frame is shown in FIG. 3. On the inside of the door leaves 1*a*, 1*b* there is at least one vertically guided roller 9, which is held at a defined distance from the inside of the door leaf 1*a*, 1*b* in a mount 9*a*. A corresponding detail of the door leaf of a door 1 or the door leaf 1*a*, 1*b* with the roller 9 is shown in FIG. 3. The actual locking element 10 is disposed opposite on the inside of the door frame and is also shown as an individual part in FIG. 3. A mount 11 which has a rear recess 11*a* within which the vertical connecting shaft 8*a* or 8*b* (not illustrated in FIG. 3) extends is attached to the inside of the door frame. A spring-loaded spagnolet or a latch 12 is mounted so as to be capable of pivoting horizontally about an axis 12*a* of rotation on a protruding section 11*b*, front left in the viewing direction, of the mount 11. The swinging movement of the spagnolet 12 toward the outside is limited by a stop 11*c*. The spagnolet 12 has a protruding or projecting locking body or section 12*b* and opposite this a lug 12*c*, the body or section 12*b* and the lug 12*c* bounding a semicircular or claw-shaped recess 12*d*. The claw-shaped recess 12*d* encloses the roller 9, which is disposed on the inside of the door leaf 1*a*, during the locking process. The locking section 12*b* is significantly longer than the lug 12*c*. The tension spring (not shown in FIG. 3) for the spagnolet 12 is coupled to the rear section of the mount 11 and ensures that, in the unlocked state, the spagnolet 12 is swung against the stop 11*c* and is located in a position that is ready for engagement for the subsequent locking process. In order to finally lock the respective door leaf in the closed position, a locking bracket 13 is disposed on the mount 11. The locking bracket 13 is pivotably mounted with its bent section 13*a* in a lateral component piece lid of the mount 11 by a horizontal bolt 13*b*. An upper limb 13*c* of the bracket 13 has, at its front end, a downwardly directed angled portion 13*d* on which a movable roller 13*f* is mounted by a bolt 13*e*, the bolt 13*e* being connected in the manner of a rotary joint by lever arm 13*g* to a vertically disposed locking rod 14. A tension spring 13*i*, which is connected to the mount 11, is coupled to a lower limb 13*h* of the locking bracket 13. In order to lock the door leaf in the closed position (in the position the locking section 12*b* of the spagnolet 12 is in a parallel position to the door leaf), the locking bracket 13 is swung about its axis 13*b* of rotation by the spring force of the tension spring 13*i*, as a result of which the roller 13*f* is moved directly in front of the locking section 12*b* of the spagnolet 12 and locks it. The locking process can additionally also be supported by the triggered movement of the locking rod 14 in the downward direction.

Release of the lock, that is to say unlocking, is not brought about again until the locking bracket 13 is swung in the clockwise direction into home position by activation of the locking rod 14 in the opposite, upward direction, and the spagnolet 12 can easily be moved out of the region with the locking bracket 14 in the outward direction (in the clockwise direction) by a swinging movement.

At the front end of the lower limb 13*h* of the locking bracket 13 there are two bores 13*j* which lie on a common axis and they have the purpose of receiving a bolt for attaching a bar for transmitting the vertical movement to a further locking element for the locking and unlocking processes.

The method of operation of the lock is as follows.

During the closing movement of the door or the door leaves 1*a*, 1*b*, the vertically guided roller 9 which is located on the inside of the door engages with the semicircular or claw-shaped recess 12*d* of the spagnolet 12. The spagnolet 12 is swung further in the direction of the center of the door opening, in the counterclockwise direction, by the pressing movement of the door in the direction of the closing edge that is brought about by the guide. In this context, the roller 13*f* of the locking bracket 13 is in contact with the upper face of the locking section 12*b* and rolls on it. The locking section 12*b* is swung into the opening of the bracket 13. After a position parallel to the door or door leaf is reached, the locking bracket 13 is swung downward about its axis 13*b* of rotation by the applied spring force, and the roller 13*f* moves directly in front of the locking section 12*b*. In this state, the final locking position is reached.

Figure 4:
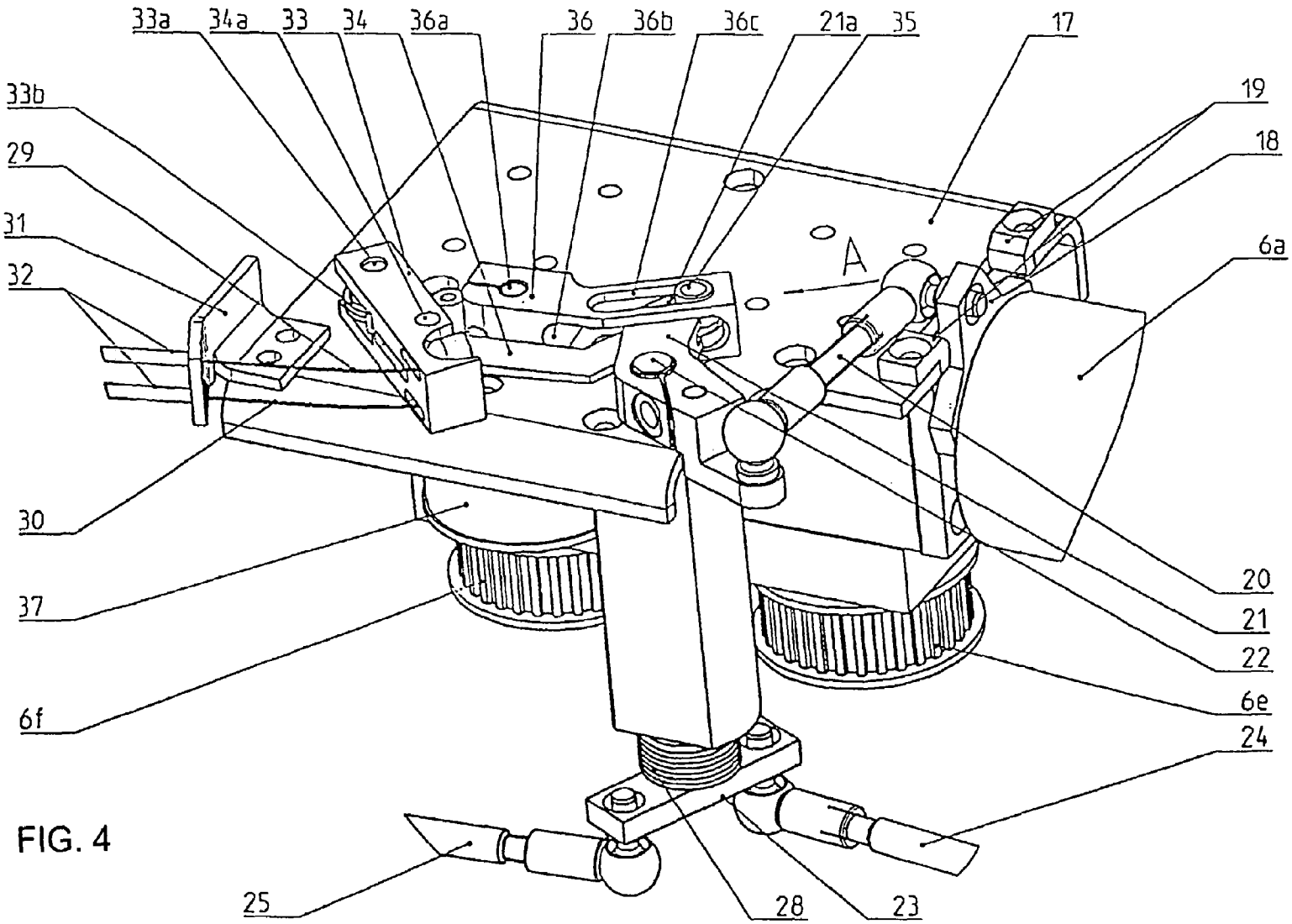
FIG. 4 is an enlarged, perspective view of detail "Y" shown in FIG. 2.

On the rotary column or the vertical connecting shaft 8*a*, 8*b*, a pin (not shown in the drawing), which is moved along with the rotary column during the opening of the door or door leaves and locks the spagnolet 12 in the opened position of the door or door leaves so that the latter can no longer manually be moved back again into its locked position, is additionally disposed. The necessary activation elements for the locking and unlocking including the manually trippable emergency unlocking process and decoupling of the emergency unlocking device are mounted on a mounting plate 17 which is disposed underneath the base plate 5 and which is attached to the base plate 5 via nonillustrated spacer elements, see FIGS. 1, 2 and 4.

The reaction force of the drive motor 6*a*, whose motor housing can be rotated about its axis, can be used to trigger the necessary movement for the unlocking process directly before the opening movement of the door leaves or the support for the locking process during the closing movement of the door leaves 1*a*, 1*b*.

The rotary movement of the housing of the motor 6*a* that is disposed in the horizontal installation position is transmitted to a segment plate 18 that is connected to the motor housing. The segment plate 18 is guided in a lateral recess of the mounting plate 17 and projects beyond the mounting plate 17. The rotary movement of the segment plate 18 is limited by two stops 19 that are attached to the mounting plate 17 (see FIG. 4). A traction rod 20 is attached in the manner of a rotary joint to the upwardly projecting section of the segment plate 18, the traction rod 20 transmits the rotary movement of the motor housing to a horizontal lever 21 which is attached to the mounting plate 17 in the manner of a rotary joint. The swinging lever 21 is connected at its axis of rotation to a rigid, vertically downwardly directed shaft 22 that is stressed by a rotary spring 28. A lever 23, to which the movement of the traction rod 20 is transmitted via the swinging lever 21 and the shaft 22, is attached centrally to the lower end of the shaft 22. Horizontally disposed coupling rods 24 and 25 are coupled to the two ends of the lever 23 and the rotary movements of the lever 23 is converted into linear movements by the rods 24, 25. The coupling rods 24 and 25 which are disposed offset with respect to one another extend, as shown in FIGS. 1 and 2, into the region of the outer closing edges of the door frame, and are bent downwards at their ends and coupled to triangular hinged plates 26, 27 which are rotatably mounted in the upper region of the wagon body. The respective locking rods 14, by which the movement of the locking brackets 13 is triggered, are coupled to the third pivot point of the hinged plates 26 or 27.

In the closed state of the door leaves 1*a*, 1*b*, the door leaves are also locked to the two outer closing edges. The spagnolet 12 is in engagement with the rollers 9 which are disposed on the inside of the door leaves, and the locking brackets 13 are pulled downwards by the spring force of the traction springs 13*i* which engage on them, and the rollers 13*f* are located directly before the locking section 12*b* of the spagnolets 12. The swinging lever 21 that is attached to the mounting plate 17 is secured in the locked position by the rotary spring 28.

The unlocking process is initiated by the door opening instruction. The drive energy which is generated when the d.c. motor 6*a* is activated is transmitted by the conical gear mechanisms 6*b*, 6*c*, the toothed belt gear mechanism and the slewing gears 4*a*, 4*b* to the toothed racks 3*a*, 3*b* which are attached to the door leaves 1*a*, 1*b*. The slewing gears 4*a*, 4*b* generate, in conjunction with the outwardly bent section of the toothed racks 3*a*, 3*b*, a force that counteracts the locking process, constituting the blocking process by the locked door leaves. The blocking process generates a reaction torque at the d.c. motor 6*a*, as a result of which the housing of the motor 6*a* rotates about the drive axis. The rotary movement is transmitted to the traction rod 20 via the segment plate 18, and the pivoted lever 21 is rotated in the counterclockwise direction, overcoming the applied spring force. The rotary movement of the pivoted lever 21 is transmitted via the vertical shaft 22 to the lever 23, as a result of whose rotary movement in the counterclockwise direction the coupling rods 24 and 25 which are coupled to the latter execute a linear pulling movement and as a result the respective vertical locking rods 14 are raised by the hinged plates 26 and 27, and the locking brackets 13 swing upward about their axis 13*b* of rotation and clear the spagnolet 12 or its locking section 12*b*. With the blocking of the movement of the door leaves 1*a*, 1*b* having now been released, the transverse displacement and subsequent longitudinal displacement of the door leaves is completed by the combination of the slewing gear/toothed rack and the drive energy of the motor. In the process, the rollers 9 on the inside of the door disengage from the spagnolet 12 which rotates in the clockwise direction as far as the stop 11*c* as a result of the applied spring force.

During the closing process, the locking takes place in the reverse order, the locking movement being brought about primarily by the spring force that is applied to the locking bracket 13.

A first embodiment variant of the emergency unlocking process according to the invention will be explained in more detail below. The activation of the emergency unlocking device is carried out either by an emergency unlocking handle with a square latching device or an emergency unlocking button. In this context it is also possible to integrate the external emergency unlocking device in the door leaf. A Bowden cable 29, 30 is attached in each case as a traction device 29, 30 to the emergency activation device. The Bowden cables 29, 30, one of which is intended for the inside of the door and the other for the outside of the door, are guided as far as the mounting plate 17 and are held in guides 32 in a mount 31 which is attached to the mounting plate 17, and are attached to a first, spring-loaded pivoted lever 33 and stressed by it. The axis of rotation of the pivoted lever 33 is indicated by 33*a*, and a rotary spring by 33*b*. On the pivoted lever 33, a second lever 34, which is embodied as a bent clip, is secured in the manner of a rotary joint about an axis 34*a* of rotation, offset with respect to the pivoting axis 33*a*. At the end of the clip 34 which lies opposite the axis 34*a* of rotation, a vertically oriented bolt 35, which is operatively connected to a third lever 36, is disposed so as to be capable of rotating in the clip 34. The lever 36 is attached to a shaft 36*a* that forms the vertical axis of rotation, so as to be capable of rotating on the mounting plate 17. The lever 36 has a cutout that serves as a horizontal guide 36*b*. In the upper and lower component pieces of the lever 36 which bound the cutout, there are two congruent elongate holes 36*c* in which the bolt 35 of the clip 34 is displaceably guided. The two elongate holes 36*c* thus form a vertical guide for the bolts 35 of the clip 34. The spring-loaded, fourth pivoted lever 21 which is disposed, as already explained, on the mounting plate 17 and is operatively connected to the traction rod 20, has, at its end lying opposite the coupling point of the traction rod 20, a semi-circular or claw-shaped recess 21*a* which engages with the bolt 35, both in the locked and unlocked state of the lock. In order to ensure that the bolt 35 engages in the recess 21*a*, the lever 36 is operatively connected to the spring of a rotary magnet 37.

Furthermore, a decoupling device for the emergency lock is also provided. For this purpose, the spring-loaded rotary magnet 37 is located on the downwardly extended shaft 36*a* of the lever 36. The emergency unlocking process is decoupled by a signal which is triggered by the door controller and by which the rotary magnet is supplied with electrical voltage and rotates the shaft 36, and thus lever 36, in the counterclockwise direction.

The method of operation of the emergency unlocking device and the decoupling device is as follows.

By manually activating the emergency handle on the inside or outside of one of the doors, the pivoted lever 33 is rotated in the clockwise direction by a respective Bowden cable, and the clip 34 is thus moved along and the bolt 35 which is positively guided in the elongate holes 36*c* is displaced in the direction indicated by an arrow A. Since the bolt 35 engages with the pivoted lever 21, the latter is rotated in the counterclockwise direction about its pivoting axis, and thus moves the coupling rods 24 and 25 by the shaft 22 and the lever 23, the coupling rods 24, 25 triggering the unlocking by the rods 14, as already explained in detail.

In order to bring about decoupling, the rotary magnet 37 is supplied with voltage and rotates the shaft 36*a*, and thus the lever 36 in the counterclockwise direction, as a result of which the bolt 35 disengages from the claw-shaped recess 21*a* of the pivoted lever 21. In this state, the emergency unlocking device is decoupled, and when the emergency unlocking device is activated the pivoted lever 21 is no longer moved and the locked state continues.

If the emergency unlocking device is to be activated again, the supply of voltage to the rotary magnet 27 is interrupted and the lever 36 is moved back again into its home position by the applied spring force, and in the process the bolt 35 engages again with the claw-shaped recess 21*a* of the pivoted lever 21.

Figure 5:
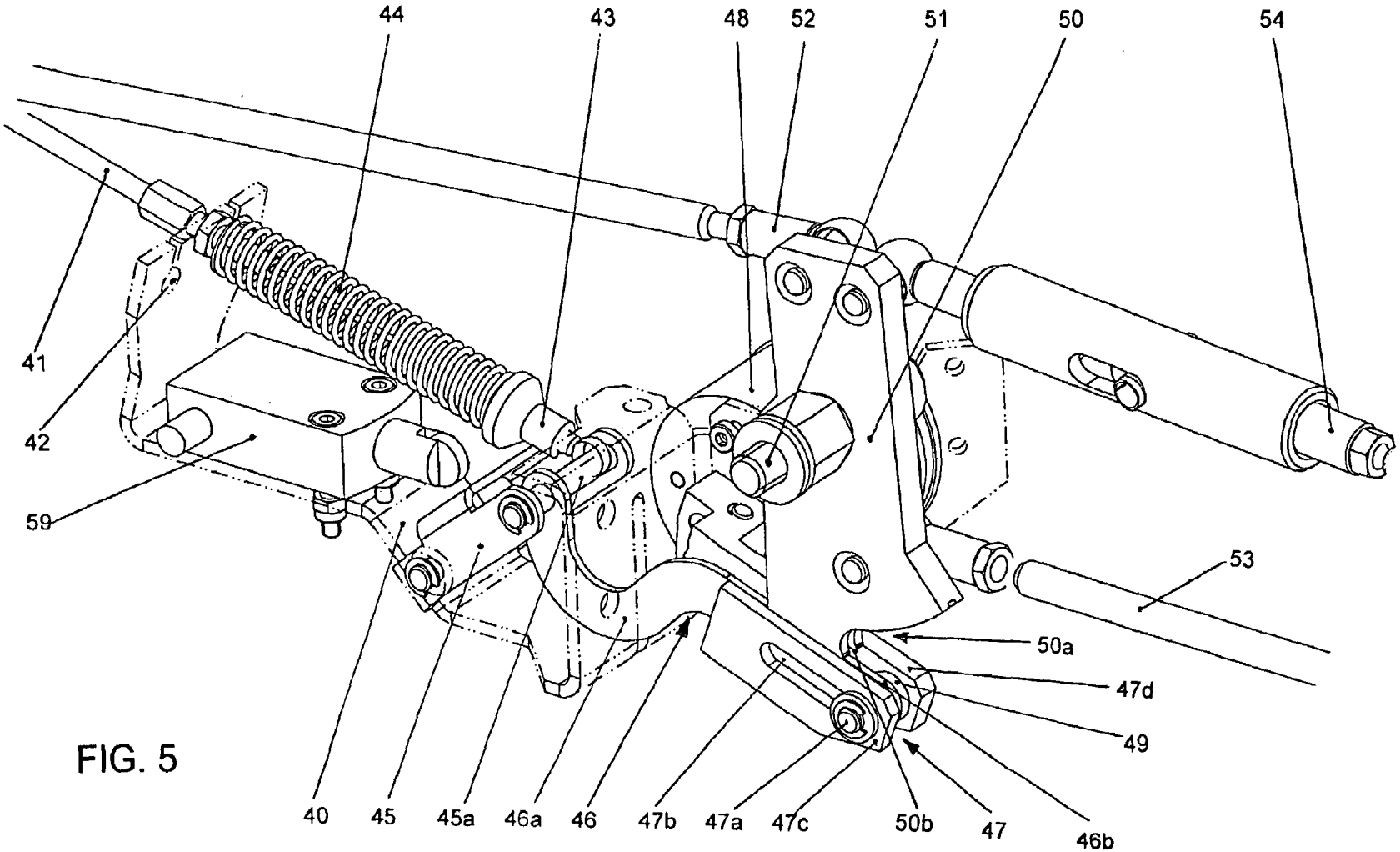
FIG. 5 is a perspective view of a further embodiment variant of the emergency unlocking device with decoupling.
Figure 6:
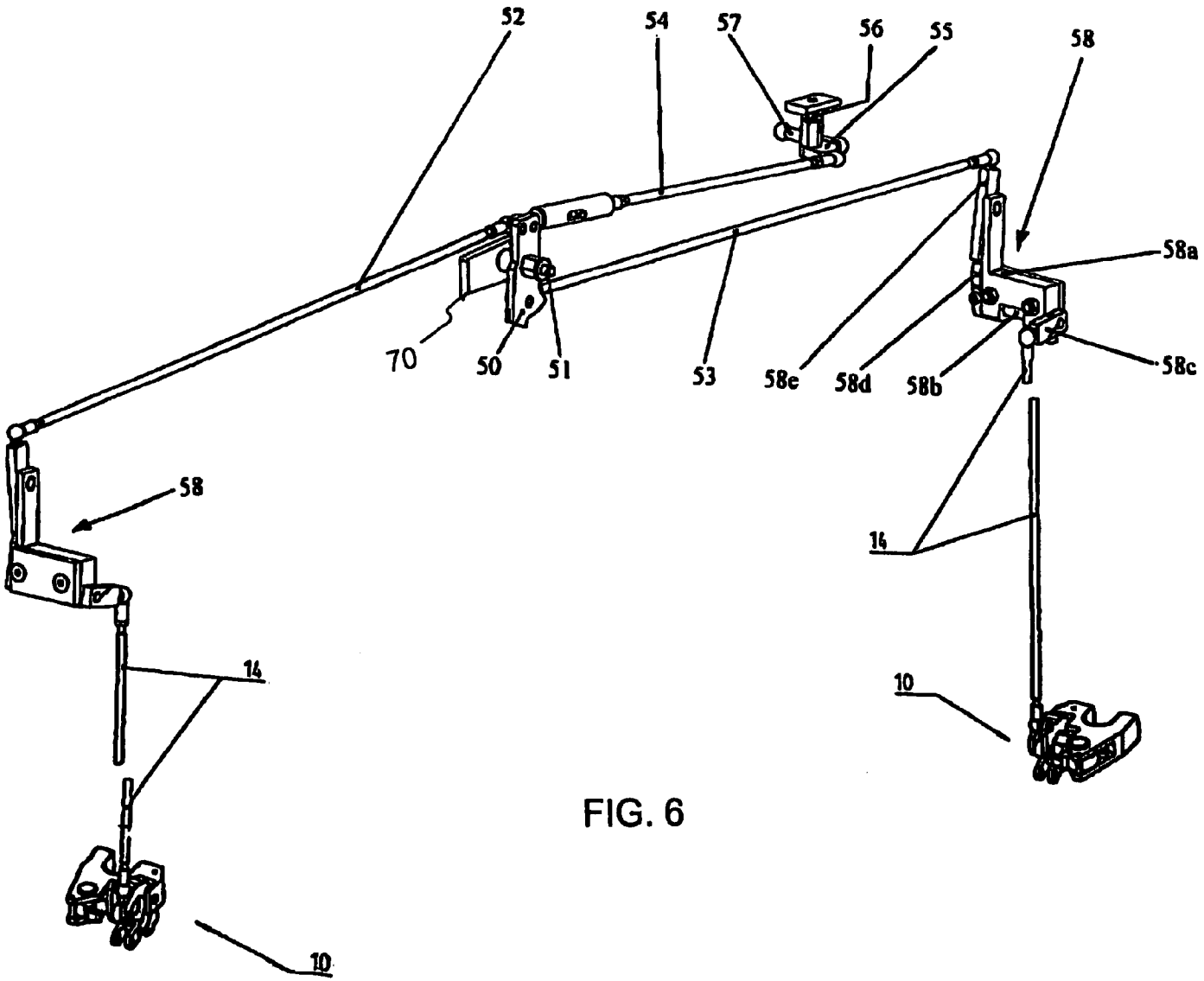
FIG. 6 is a perspective view of the locking and unlocking mechanism which is intended for the embodiment variant according to FIG. 5 and is disposed on the door frame.

FIGS. 5 and 6 show a further embodiment variant of the emergency unlocking device with decoupling facility.

The Bowden cable 41, functioning as a traction device 41, is guided in a guide 42 on a mount 40 that is disposed in the upper region of the door frame on a non-illustrated carrier element, and the Bowden cable 41 is attached to an attachment nipple 43. The latter engages on a first lever 45 that is pivotably mounted on the mount 40 and is embodied as a bracket-like lever. A compression spring 44, which presses against the pivoted lever 45 and that surrounds the Bowden cable 41 is disposed between the guide 42 and the attachment nipple 43. A second lever 46, which is composed of a bent component piece 46*a* and straight component piece 46*b* engages on an upper bolt 45*a* of the pivoted lever 45, in addition to the attachment nipple 43. The end of the straight component piece 46*b* is connected to a bolt 47*a* that is guided by its two ends in congruent elongate holes 47*b* of a third lever 47 which has a U-shaped cross section. The elongate holes 47*b*are located in the two side walls 47*c*, 47*d* of the lever 47. The one side wall 47*d* of the U-shaped lever 47 has an extended section which is connected to the axial shaft of a spring-loaded rotary magnet 48. In each case a disk 49 is. disposed on the bolt 47*a* between the straight component piece 46*b* of the lever 46 and the side walls 47*c*, 47*d* of the U-shaped lever 47. A fourth lever 50, which is embodied as a hinged plate, is mounted on a horizontally disposed shaft 51 on a mounting plate 70 in the upper region of the door frame. The hinged plate 50 has, at its front end side which points in the direction of the bolt 47*a*, an arcuate recess 50*a* in the lower region. The section which bounds the arcuate recess 50*a* engages, during the unlocking process, with the disks 49 which are disposed on the bolt 47*a* of the lever 47. The lower end section of the hinged plate 50 has a slot-like cutout 50*b* that extends in the longitudinal direction and which is slightly larger than the wall thickness of the straight component piece 46*b* of the lever 46 so that secure and reliable contact between the disks 49 and the hinged plate 50 is ensured. The slotlike recess 50*b* also serves as a guide for the straight component piece 46*b* of the lever 46. A coupling rod 52 and 53 engages on each of the upper and lower regions of the hinged plate 50 opposite one another by ball and socket joints, the coupling rods 52 and 53 being operatively connected to the vertical locking rods 14 via corresponding deflection units 58 (FIG. 6). The two coupling rods 52, 53 that extend in the opposite direction are disposed offset to one another vertically in terms of their height. The coupling point for the coupling rod 53 on the hinged plate 50 is located directly above the arcuate recess 50*a*. A rod 54 via which the necessary movement force for triggering the locking and unlocking is transmitted also engages on the upper end of the hinged plate 50, opposite the coupling rod 52, by a ball and socket joint. The rod 54 is connected at its end opposite the hinged plate 50 to one of the end sides of an eccentrically mounted plate 55, as shown in FIG. 6. The plate 55 is pivotably mounted on a vertical shaft 56. A tappet 57 engages on the plate 55 approximately diagonally opposite the coupling point of the rod 54, the tappet 57 being made to move to and fro starting from the direction of rotary movement of the motor housing. The tappet 57 transmits this movement to the pivotable plate 55 that moves about its axis 56 of rotation, as a result of which the rod 54 triggers the movement of the hinged plate 50 (FIG. 5).

The method of operation of the emergency unlocking device is as follows.

The manual activation of the emergency unlocking switch causes the pivoted lever 45 to be pulled in the direction of the guide 42 by the Bowden cable 41, counter to the effect of the compression spring. The movement is transmitted to the lever 46 which also moves the bolt 47*a*, guided in the elongate holes 47*b* of the U-shaped lever 47, as a result of which the disks 49 engage with the hinged plate 50 (in the arcuate recess 50*a*) and the hinged plate 50 is swung in the clockwise direction. The locking rods 14 are raised by the coupling rods 52 and 53 and the deflection units 58 and the locking of the door or door leaves is triggered. A signal that indicates to the train driver on a display that the emergency unlocking device has been activated is triggered by a monitoring switch 59 that is attached to the mount 40. The two deflection units 58 are composed of an angular piece 58*a* with a horizontal shaft 58*b*, to each of whose ends a lever 58*c*, 58*d* is attached. The lever 58*c* is connected to the locking rod 14 via a ball and socket joint. The other lever 58*d* has, at its upwardly pointing end, a protruding semicircular lug which engages in a corresponding recess in a further lever 58*e* which is rotatably mounted on the vertical limb of the angular piece 58*a*, and is connected by its other end to the respective coupling rod 52, 53 by a ball and socket joint. The horizontal movement of the coupling rods 52, 53 is converted into a vertical movement of the locking rods 14 by the deflection units 58.

In order to decouple the emergency unlocking device, the rotary magnet 48 is supplied with electrical voltage and turns the shaft, and thus the lever 47, in the clockwise direction, as a result of which the disks 49 disengage from the arcuate recess 50*a* of the U-shaped lever 50, as shown in FIG. 5. In this state, the emergency unlocking device is decoupled, and when the emergency unlocking device is activated the hinged plate 50 is no longer moved and the locked state continues.

If the emergency unlocking device is operated again, the supply voltage to the rotary magnet 48 is disconnected and the lever 47 is moved back into its home position again by the applied spring force.

The embodiment variant explained above has the advantage that it requires a small amount of mounting expenditure and all the movable rods are only loaded in a tensile fashion.

We claim:

1. An emergency unlocking device for locking and unlocking systems for swinging sliding doors, the emergency unlocking device comprising:

a spring-loaded rotary magnet having an axial shaft;

a bolt;

a lever system having a first spring-loaded pivoted lever, a second lever connected to said first spring-loaded pivoted lever, a third lever connected to said second lever, and a fourth lever, said third lever attached to said axial shaft of said spring-loaded rotary magnet and having elongate holes formed therein for displaceably mounting said bolt;

a traction device for engaging on said lever system, said traction device connected to said first spring-loaded pivoted lever which is connected through said second lever to said third lever, said bolt moving into an engagement position when said traction device is subjected to tensile stress;

a further shaft, said fourth lever pivotably mounted on said further shaft, said further shaft moving said fourth lever;

horizontally disposed coupling rods;

locking rods which can be moved in a vertical direction;

deflection units, said fourth lever operatively connected through said horizontally disposed coupling rods and said deflection units to said locking rods; and a rod through which a force component which brings about a locking and an unlocking of the swinging sliding doors can be temporarily applied connected to said fourth lever.

2. The emergency unlocking device according to claim 1, wherein:

said second lever is a bent clip which is held in said first spring-loaded pivoted lever in a manner of a rotary joint so as to be offset with respect to an axis of rotation of said first spring-loaded pivoted lever, and said bolt is disposed in the vertical direction on a protruding end of said bent clip and is operatively connected to said third lever;

said third lever has a third recess formed therein which serves as a horizontal guide and said elongate holes are congruent elongate holes serving as a vertical guide; and said fourth lever has, at an end pointing to said third lever, a fourth recess formed therein and selected from the group consisting of a semicircular recess and a claw-shaped recess, said fourth recess temporarily engages with said bolt which is guided in said third lever.

3. The emergency unlocking device according to claim 2, wherein said rod is a traction rod which is connected to said fourth lever, opposite to said fourth recess of said fourth lever, for transmitting a movement force.

4. The emergency unlocking device according to claim 2, wherein for decoupling the emergency unlocking device, said axial shaft of said spring-loaded rotary magnet forming an axis of rotation for said third lever, is disposed in the vertical direction, and in a state in which voltage is applied to said spring-loaded rotary magnet, said third lever moves in a counterclockwise direction and as a result said bolt disengages from said claw-shaped recess of said fourth lever.

5. The emergency unlocking device according to claim 1, further comprising a mounting selected from the group consisting of a horizontally disposed plate and a carrier element; and wherein said first spring-loaded pivoted lever, said third lever and said fourth lever are embodied as pivoted levers mounted on said mounting.

6. The emergency unlocking device according to claim 1, wherein:

said fourth lever has an axis of rotation and is rigidly connected to said further shaft; and said further shaft is a vertical shaft lying on said axis of rotation of said fourth lever.

7. The emergency unlocking device according to claim 1, further comprising a further lever attached to said horizontally disposed coupling rods for transmitting a movement force for the locking and unlocking processes, said further shaft having a lower end attached to said further lever.

8. The emergency unlocking device according to claim 1, further comprising:

a spring;

a further bolt; and a mount having a guide in which said traction device is held under tension by said spring, said mount disposed in an upper region of a door frame of the swinging sliding doors, said first spring-loaded pivoted lever being a clip-shaped lever spaced apart from said guide and pivotably mounted on said mount, said first spring-loaded pivoted lever having arms connected at an upper end by said further bolt, and said traction device and said second lever engage said further bolt.

9. The emergency unlocking device according to claim 8, wherein said second lever has a bent component piece and a straight component piece, said bent component piece having an upper end connected to said further bolt, said straight component piece having an end mounted centrally on said bolt of said third lever.

10. The emergency unlocking device according to claim 9, wherein said third lever is a U-shaped lever having side walls with said elongate holes formed therein, said side walls include a rear side wall having an elongated section connected to said axial shaft of said spring-loaded rotary magnet, and said spring-loaded rotary magnet is disposed horizontally.

11. The emergency unlocking device according to claim 10, further comprising:

a mounting plate disposed on the upper region of the door frame of the swinging sliding doors;

said further shaft horizontally disposed on said mounting plate, said fourth lever is a hinged plate mounted on said further shaft, said hinged plate contains a lower region having an end with an arcuate recess formed therein and a slit-shaped cutout formed therein, said slitshaped cutout extending in a longitudinal direction and at least partially engages said straight component piece of said second lever.

12. The emergency unlocking device according to claim 11, further comprising a disk, said disk which, when said traction device is subjected to tensile stress, engages with a section of said fourth lever which delimits said arcuate recess and is disposed on said bolt adjacent to said straight component piece of said second lever.

13. The emergency unlocking device according to claim 12, wherein:

said hinged plate has an upper region and said lower region;

said coupling rods connected to said hinged plate in said upper region and in said lower region, said coupling rods being each vertically offset with respect to one another, said coupling rods extend horizontally in opposite directions and are operatively connected to said locking rods by said deflection units in a region of vertical closing edges of the door frame.

14. The emergency unlocking device according to claim 13, further comprising a motor having a rotatable housing; further comprising a vertical shaft;

further comprising a further plate rotatably mounted in an eccentric fashion on said vertical shaft and having a first end side and a second end side;

further comprising a tappet engaging said first side of said further plate, said tappet connected to said rotatable housing of said motor; and wherein said rod having a first end engaging said hinged plate directly opposite a coupling point of one of said coupling rods and a second end engaging on said second end side of said further plate.

15. The emergency unlocking device according claim 14, wherein for decoupling the emergency unlocking device, a voltage is applied to said springloaded rotary magnet and as a result said U-shaped lever which is connected to said axial shaft of said spring-loaded rotary magnet pivots in a clockwise direction and as a result said bolt with said disk disengages from said arcuate recess of said hinged plate.

16. The emergency unlocking device according claim 1, wherein the swinging sliding doors are doors for rail vehicles.

* * * * *